US011245217B2

(12) United States Patent
Chen et al.

(10) Patent No.: US 11,245,217 B2
(45) Date of Patent: Feb. 8, 2022

(54) ELECTRICAL CONNECTOR AND MANUFACTURING METHOD THEREOF

(71) Applicant: Tarng Yu Enterprise co., ltd., New Taipei (TW)

(72) Inventors: Ying-Chung Chen, New Taipei (TW); Mu-Jung Huang, New Taipei (TW)

(73) Assignee: TARNG YU ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/920,601

(22) Filed: Jul. 3, 2020

(65) Prior Publication Data

US 2021/0005999 A1 Jan. 7, 2021

(30) Foreign Application Priority Data

Jul. 4, 2019 (TW) ..... 108123207
Oct. 3, 2019 (TW) ..... 108135937

(51) Int. Cl.
*H01R 13/424* (2006.01)
*H01R 43/20* (2006.01)
*H01R 13/502* (2006.01)

(52) U.S. Cl.
CPC ..... *H01R 13/424* (2013.01); *H01R 13/502* (2013.01); *H01R 43/20* (2013.01)

(58) Field of Classification Search
CPC ..... H01R 13/424; H01R 13/502; H01R 43/20
See application file for complete search history.

(56) References Cited

U.S. PATENT DOCUMENTS 7,597,580 B1 * 10/2009 Advey ..... H01R 13/502 439/272
8,876,558 B2 * 11/2014 Lee ..... H01R 13/6658 439/660
2011/0028045 A1 * 2/2011 Zhu ..... H01R 12/712 439/660
2012/0202363 A1 * 8/2012 McNamara ..... H01R 13/516 439/74
2013/0059479 A1 * 3/2013 Ho ..... H01R 27/02 439/639
2019/0214755 A1 * 7/2019 Manickam ..... H01R 12/721
2021/0005999 A1 * 1/2021 Chen ..... H01R 13/424

* cited by examiner

*Primary Examiner* — Abdullah A Riyami
*Assistant Examiner* — Nader J Alhawamdeh
(74) *Attorney, Agent, or Firm* — Chun-Ming Shih; Lanway IPR Services

(57) ABSTRACT

An electrical connector and a manufacturing method thereof are provided. The electrical connector includes: a terminal set having at least one middle terminal, a left terminal and a right terminal; a terminal base for allowing the middle terminal to penetrate therethrough and preventing it from touching a base body of the terminal base and for respectively positioning the left terminal and the right terminal at two sides of the middle terminal and making the left terminal and the right terminal electrically interconnected; and an insulating housing for positioning the middle terminal and the terminal base and for allowing both ends of each of the middle, left terminal and the right terminal to be respectively extended in a predetermined direction and beyond the insulating housing. The present invention can simplify manufacturing procedures of the electrical connector, more effectively assure positioning of the terminal set and improve product yield.

10 Claims, 14 Drawing Sheets

ELECTRICAL CONNECTOR AND MANUFACTURING METHOD THEREOF

CROSS-REFERENCE TO RELATED APPLICATIONS

This application claims the priority of Republic of China Patent Application No. 108123207 and No. 108135937 filed on Jul. 4, 2019 and Oct. 3, 2019, in the State Intellectual Property Office of the R.O.C., the disclosure of which is incorporated herein by reference.

BACKGROUND OF THE INVENTION

Field of the Invention

The present invention relates to electrical connectors and manufacturing methods thereof, and more particularly, to an electrical connector, which is formed from an electrical connector semi-manufacture made of a plurality of grounding terminals that are fixed in position by gripping and electrically interconnected, combined with a buried insulating housing for positioning signal terminals and the electrical connector semi-manufacture, and a manufacturing method of the electrical connector.

Descriptions of the Related Art

Electrical connectors have recently been widely applied to various electronic devices, and more and more electrical connectors are inevitably asked to be customized to special requirements and designs of the electronic devices. This however increases difficulty in manufacturing electrical connectors and brings about concern for structural strength of the electrical connectors.

An electrical connector generally includes a plurality of conductive terminals, some of which may have to be electrical interconnected. A jumper is usually used to form electrical connection between those conductive terminals, while it is liable to be deformed or damaged by external force. This thereby undesirably causes electrical connection breakage between those terminals and deteriorates yield of the electrical connector.

Therefore, how to provide an electrical connector that no jumper is needed to form electrical connection between conductive terminals, is an important task in the art

SUMMARY OF THE INVENTION

In view of the above drawbacks in the prior art, a primary object of the present invention is to provide an electrical connector and manufacturing methods thereof can effectively solve the electrical connection breakage between those grounding terminals.

According to another purpose of the invention, an electrical connector and manufacturing methods of the invention, the manufacturing procedures of the electrical connector can be simplified.

To achieve the above and other objects, an electrical connector is provided in the invention, the electrical connector including: a terminal set including at least one middle terminal, a left terminal and a right terminal; a terminal base including a base body, at least one middle terminal channel, a left terminal positioning portion and a right terminal positioning portion, wherein the middle channel is located in the base body and for allowing the middle terminal to penetrate therethrough and preventing the middle terminal from touching the base body, and the left terminal positioning portion and the right terminal positioning portion are provided on the base body and for respectively fixing the left terminal and the right terminal at predetermined positions at left and the right sides of the middle terminal and allowing the left terminal and the right terminal to be electrically connected to each other, so as to form an electrical connector semi-manufacture; and an insulating housing including a housing body, at least one middle terminal positioning portion and a terminal base positioning portion, wherein the middle terminal positioning portion and the terminal base positioning portion are provided on the housing body, and for respectively positioning the middle terminal and the terminal base of the electrical connector semi-manufacture, and allowing both ends of each of the middle, left terminal and the right terminal to be respectively extended in a predetermined direction and beyond the housing body.

Preferably, in the electrical connector said above, further the terminal base is a conductive plastic terminal base.

Preferably, in the electrical connector said above, further the terminal base further includes a terminal base coupling portion, and the insulating housing further includes a terminal base exposing structure formed on the housing body and for exposing the terminal base coupling portion to make it able to provide electrical coupling.

Preferably, in the electrical connector said above, further the left terminal positioning portion includes a left terminal gripping structure for gripping the left terminal, and the right terminal positioning portion includes a right terminal gripping structure for gripping the right terminal.

Preferably, in the electrical connector said above, further the left terminal clamping structure and a right terminal clamping structure is respectively be formed on the left and the right terminal positioning portions to clamp and position the left terminal and the right terminal respectively.

Preferably, in the electrical connector said above, further the middle terminal positioning portion includes a middle terminal embedding structure for positioning and embedding the middle terminal, and the terminal base positioning portion includes a terminal base embedding structure for positioning and embedding the terminal base.

Preferably, in the electrical connector said above, further the terminal base includes an insulating housing embedding structure for being embedded in the insulating housing.

Preferably, in the electrical connector said above, further the middle terminal is a signal terminal, the left terminal and the right terminal are grounding terminals.

Furthermore, the present invention provides an electrical connector manufacturing methods thereof, the electrical connector manufacturing methods thereof, including the steps of: providing a terminal set that includes at least one middle terminal, a left terminal and a right terminal; providing a terminal base, and allowing the terminal base to respectively fix the left terminal and the right terminal at predetermined positions at two sides of the middle terminal and make the left terminal and the right terminal electrically connected to each other, so as to form an electrical connector semi-manufacture; and providing an insulating housing, and allowing the insulating housing to respectively position the middle terminal and the terminal base of the electrical connector semi-manufacture, wherein both ends of each of the middle, left terminal and the right terminal are allowed to be respectively extended in a predetermined direction and beyond the insulating housing, so as to form a finished electrical connector, wherein the insulating housing is buried and integrally formed with the middle terminal and the terminal base.

Preferably, in the electrical connector manufacturing methods thereof said above, further including the insulating housing, for exposing the terminal base and making it able to provide electrical coupling.

Preferably, in the electrical connector manufacturing methods thereof said above, further including the terminal base is gripping or clamping, to respectively the left terminal and the right terminal, and the insulating housing is gripping, to respectively the middle terminal and the terminal base.

In comparison to prior arts, a primary object of the present invention is to provide an electrical connector and manufacturing method thereof. An electrical connector semi-manufacture is firstly formed, wherein left terminal and the right terminal (that is, grounding terminals) of a terminal set are positioned and gripped, and then an insulating housing is formed by burying technique and is used to fix a middle terminal (that is, signal terminal) and the electrical connector semi-manufacture in position. This enhances positioning of the grounding terminals and prevents them from shifting, thereby giving a lot of advantages such as improving product yield, simplifying production flow and reducing mold costs. No jumper is needed to form electrical connection between conductive terminals Thus, there is no concern for electrical connection breakage between those grounding terminals, while manufacturing procedures of the electrical connector can be simplified.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
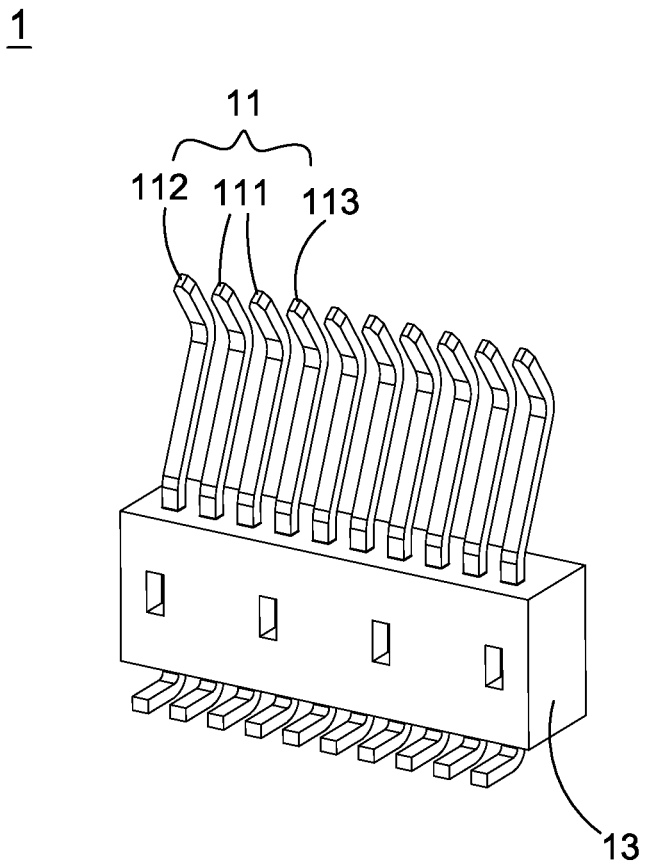
FIG. 1 is a schematic diagram at a first viewing angle of an electrical connector according to the present invention.
Figure 2:
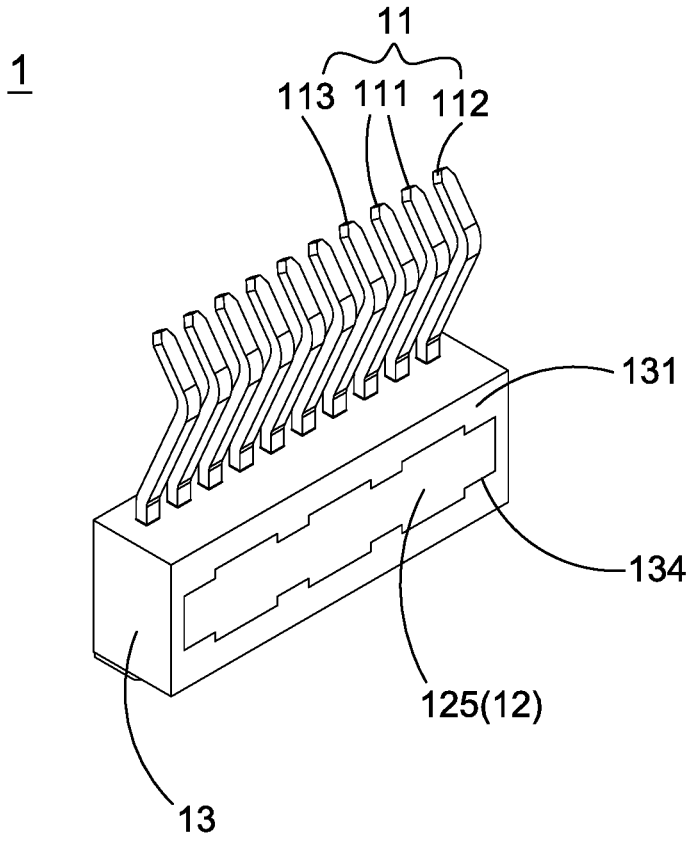
FIG. 2 is a schematic diagram at a second viewing angle of the electrical connector according to the present invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

The present invention provides an electrical connector and a manufacturing method thereof, which are described below according to their preferred embodiments with reference to FIGS. 1 to 14.

As shown in FIGS. 1 to 4, the electrical connector 1 according to the present invention includes: a terminal set 11, a terminal base 12 and an insulating housing 13. The terminal set 11 includes at least one middle terminal 111, a left terminal 112 and a right terminal 113, which are arrayed side by side. The middle terminal 111 is, for example, a signal terminal. The left terminal 112 and the right terminal 113 are, for example, grounding terminals Particularly, referring to FIGS. 10 to 12, the middle terminal 111 includes a first conducting portion 1111 and a first bonding portion 1112, which are interconnected and extendedly forwardly and outwardly, wherein the first bonding portion 1112 is bent horizontally. The left terminal 112 includes a second conducting portion 1121 and a second bonding portion 1122, which are interconnected and extendedly forwardly and outwardly, wherein the second bonding portion 1122 is bent horizontally. The left terminal 112 further includes a second gripping portion 1123 formed between the second conducting portion 1121 and the second bonding portion 1122. The right terminal 113 includes a third conducting portion 1131 and a third bonding portion 1132, which are interconnected and extendedly forwardly and outwardly, wherein the third bonding portion 1132 is bent horizontally. The right terminal 113 further includes a third gripping portion 1133 formed between the third conducting portion 1131 and the third bonding portion 1132.

The first conducting portion 1111, the second conducting portion 1121 and the third conducting portion 1131 are used to electrically contact corresponding conducting portions of an electrical connector (not shown). The first bonding portion 1112, the second bonding portion 1122 and the third bonding portion 1132 are used for being bonded to a bonding substrate or a wire (not shown). Thus, the electrical connector according to the present invention can serve as a board connector or a wire connector.

Figure 3:
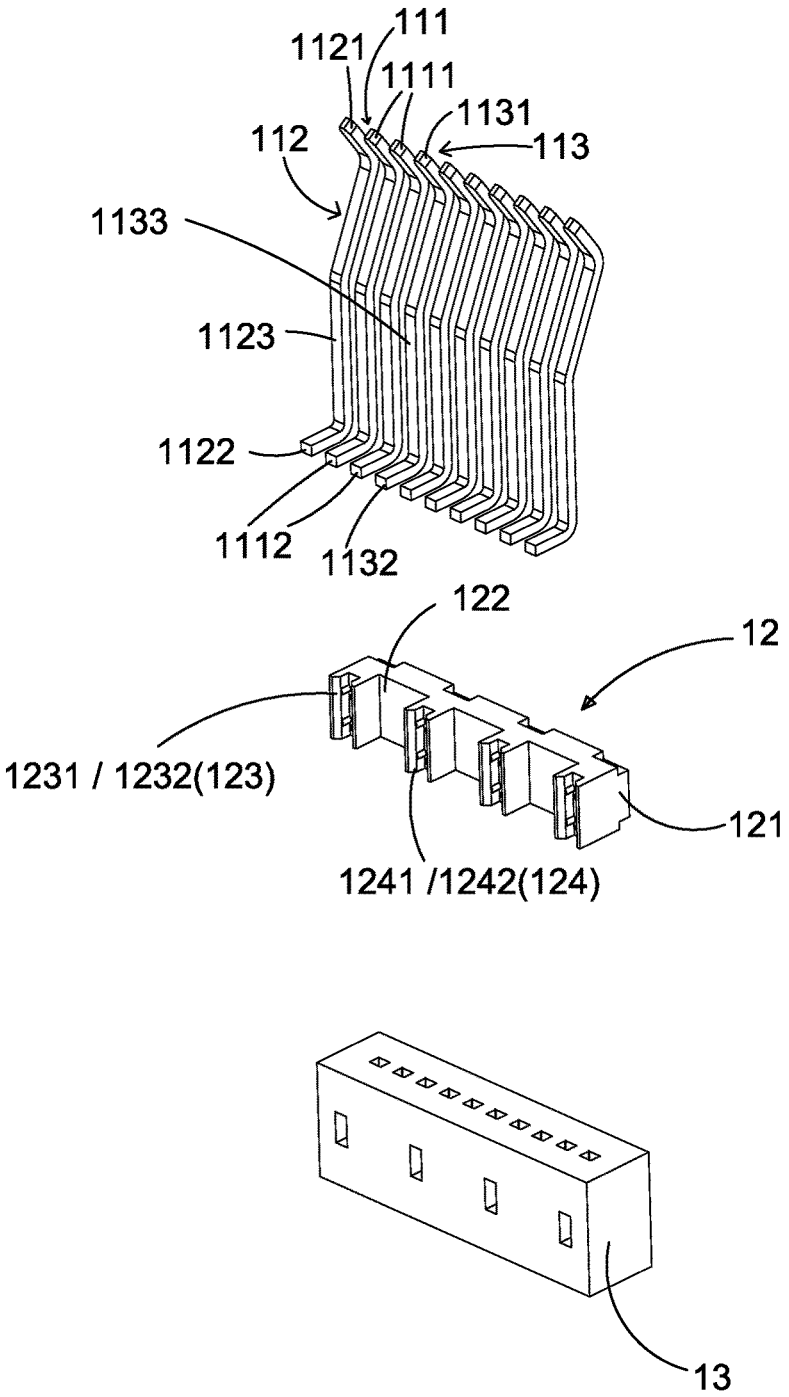
FIG. 3 is a schematic breakdown diagram at the first viewing angle of the electrical connector according to the present invention.
Figure 4:
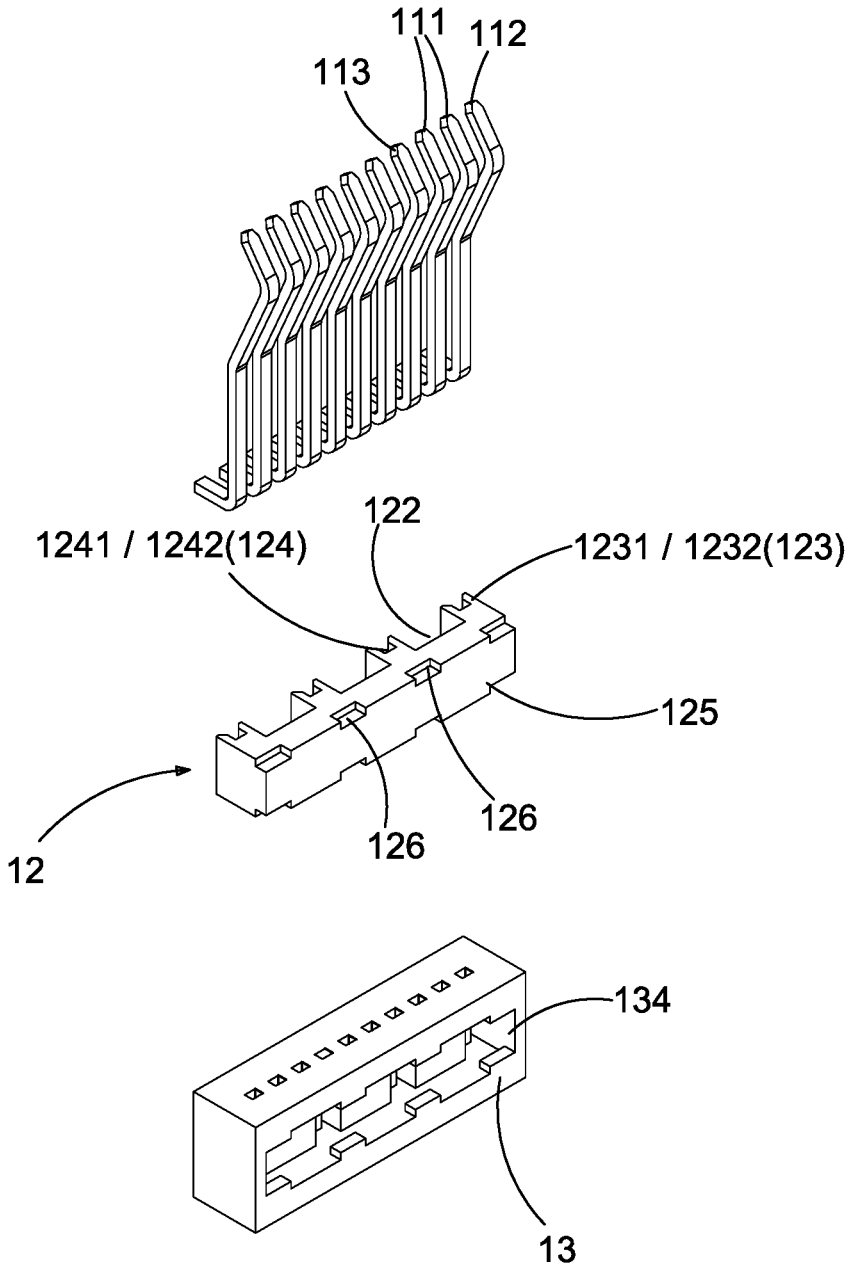
FIG. 4 is a schematic breakdown diagram at the second viewing angle of the electrical connector according to the present invention.
Figure 8:
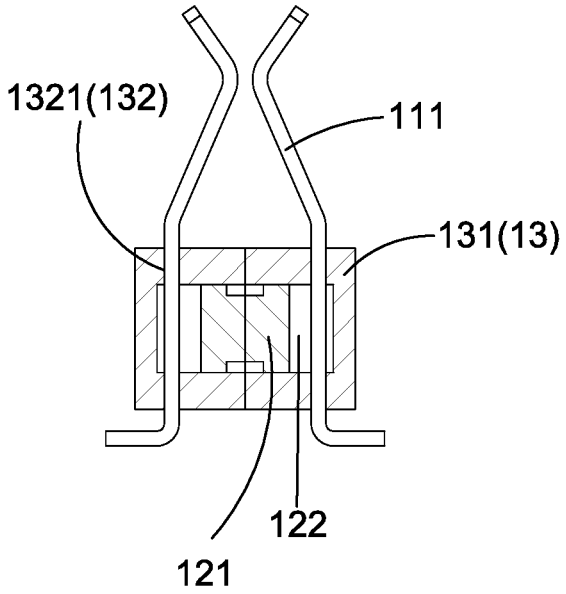
FIGS. 8 and 9 are cross-sectional views cut along line A-A and line B-B respectively of the electrical connector shown in FIG. 7.
Figure 11:
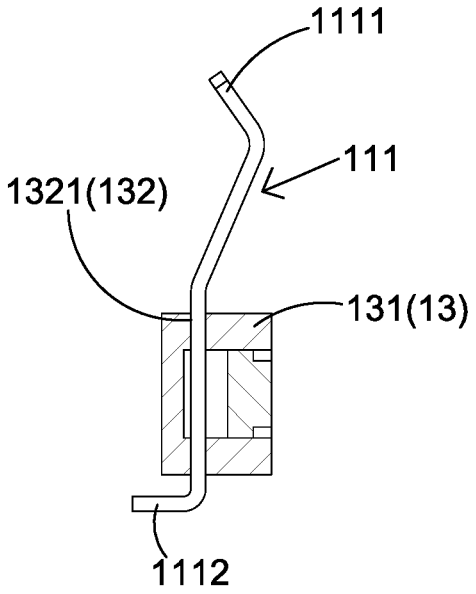
FIGS. 11 and 12 are cross-sectional views cut along line C-C and line D-D respectively of the electrical connector shown in FIG. 10.

As shown in FIGS. 3 to 4, the terminal base 12 includes a base body 121, at least one middle terminal channel 122, a left terminal positioning portion 123 and a right terminal positioning portion 124. Referring to FIGS. 8 and 11, the middle terminal channel 122 is located in the base body 121, and allows the middle terminal 111 to penetrate therethrough and prevents the middle terminal 111 from touching the base body 121.

Figure 9:
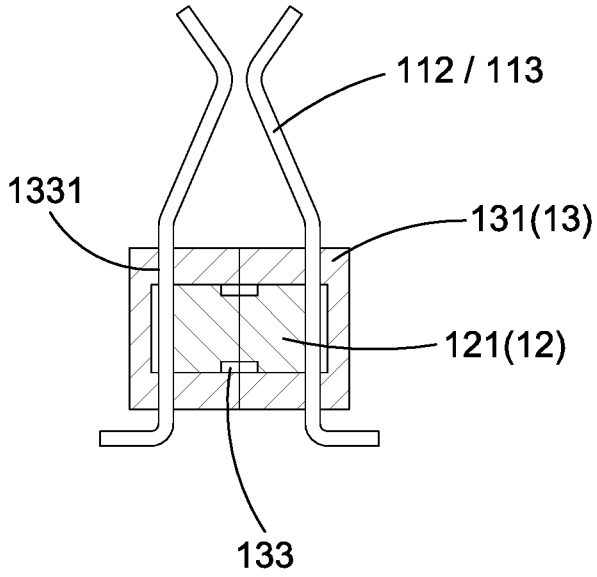
Figure 10:
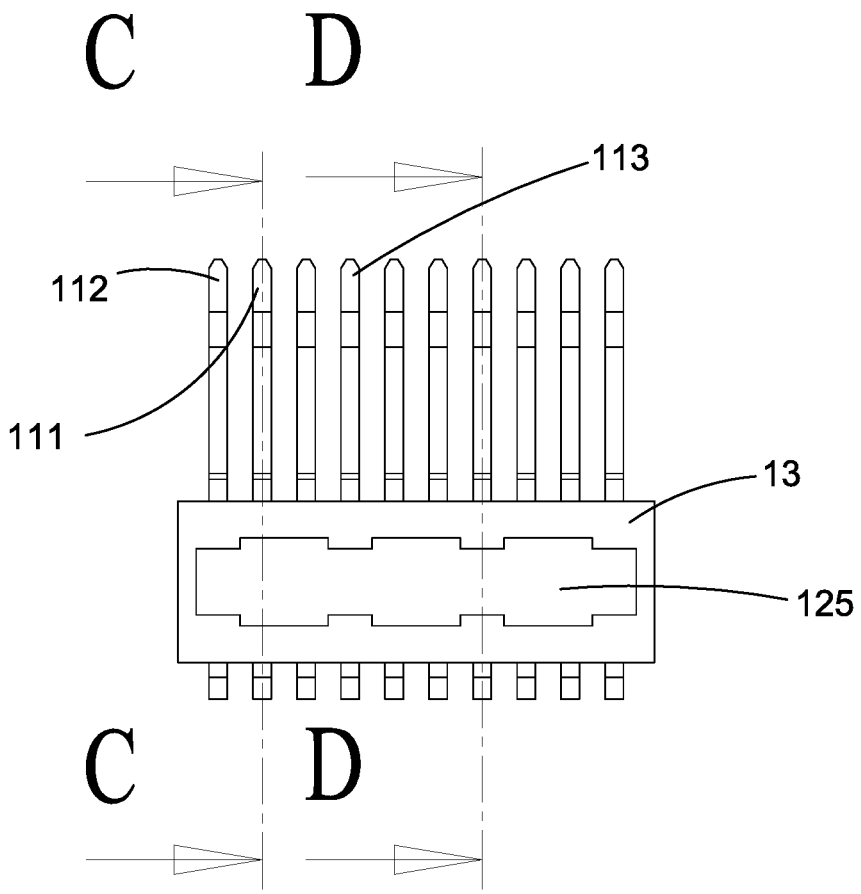
FIG. 10 is a side view of the electrical connector according to the present invention.
Figure 12:
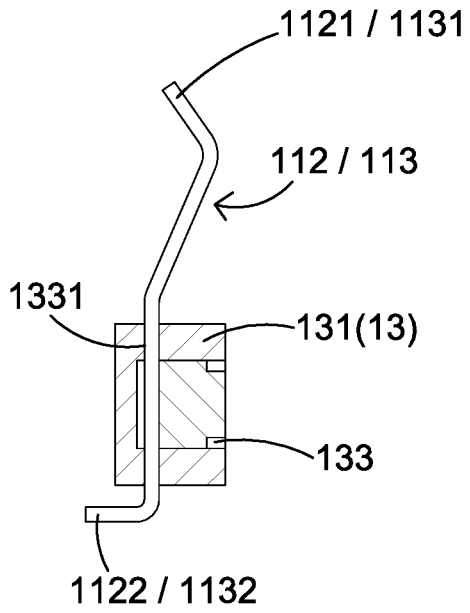
Figure 13:
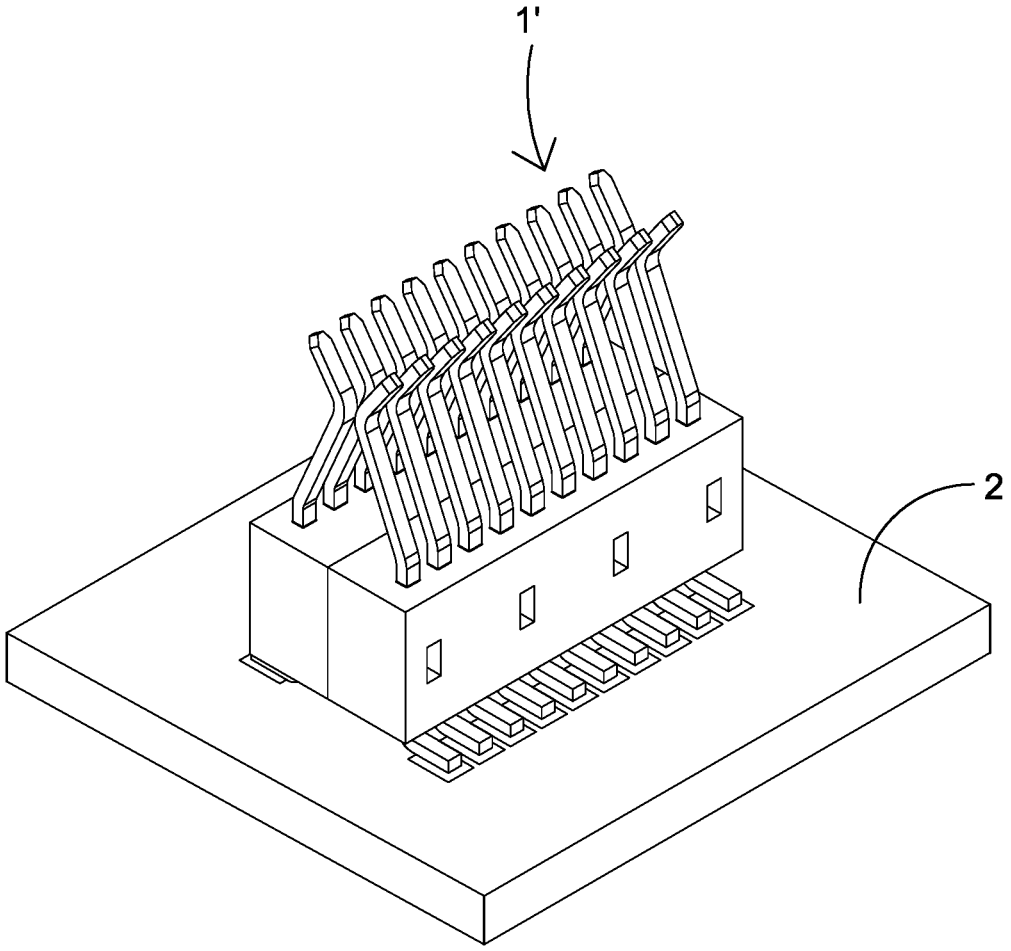
FIG. 13 is a schematic diagram showing the electrical connector of FIG. 7 mounted on a circuit substrate.

Referring to FIGS. 3, 9 and 12, the left terminal positioning portion 123 and the right terminal positioning portion 124 are provided on the base body 121, and are used to respectively fix the left terminal 112 and the right terminal 113 at predetermined positions at left and right sides of the middle terminal 111, so as to form an electrical connector semi-manufacture.

The terminal base 12 is, for example, a conductive plastic terminal base, for electrically connecting the left terminal 112 and the right terminal 113 together and preventing electrical connection breakage between the left terminal 112 and the right terminal 113. This configuration can form a grounding cavity conductor inside the terminal base 12, by which an object placed in the cavity is prevented from being affected by an external electric field, and an object placed outside the cavity is not affected by an electric field of an electrified body inside the cavity, thereby providing an electrostatic shielding effect and protecting the middle terminal 111 against any interference when it transmits high speed signals.

Figure 5:
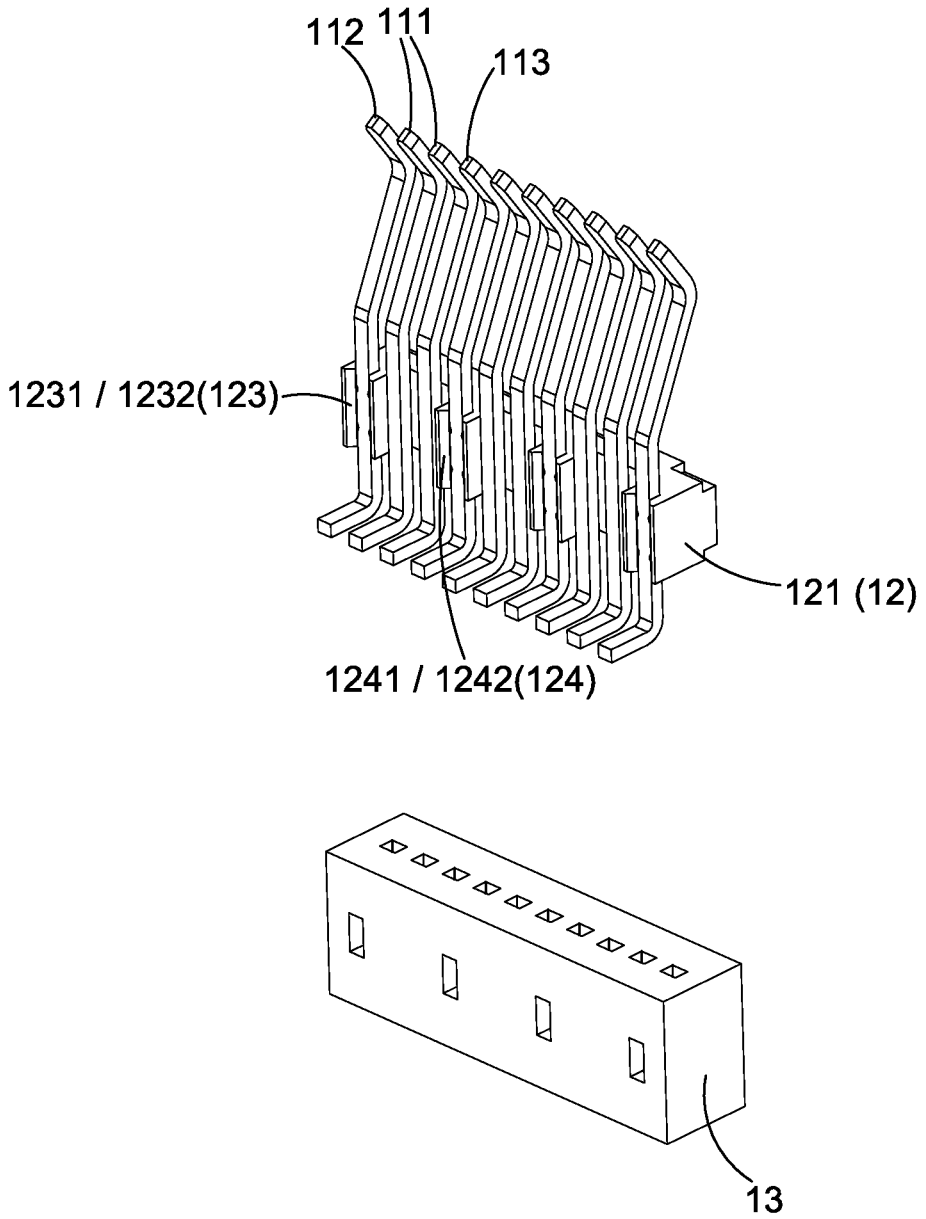
FIG. 5 is a schematic diagram at the first viewing angle of a semi-manufacture of the electrical connector according to the present invention.
Figure 6:
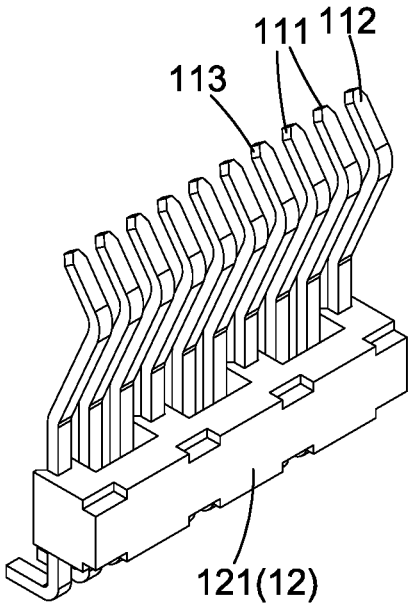
FIG. 6 is a schematic diagram at the second viewing angle of the semi-manufacture of the electrical connector according to the present invention.
Figure 6:
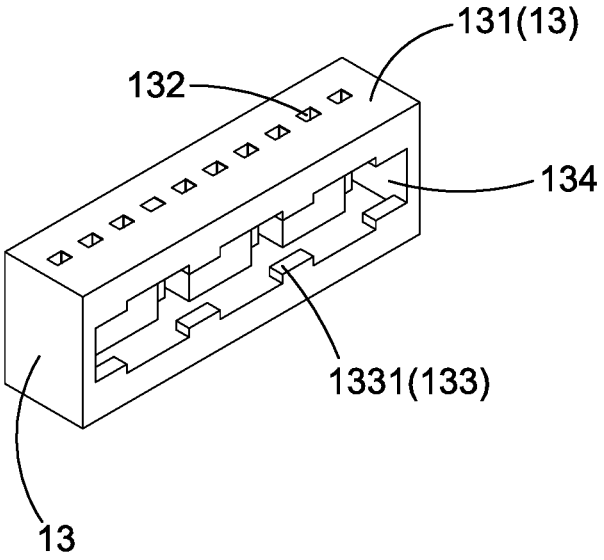
Figure 7:
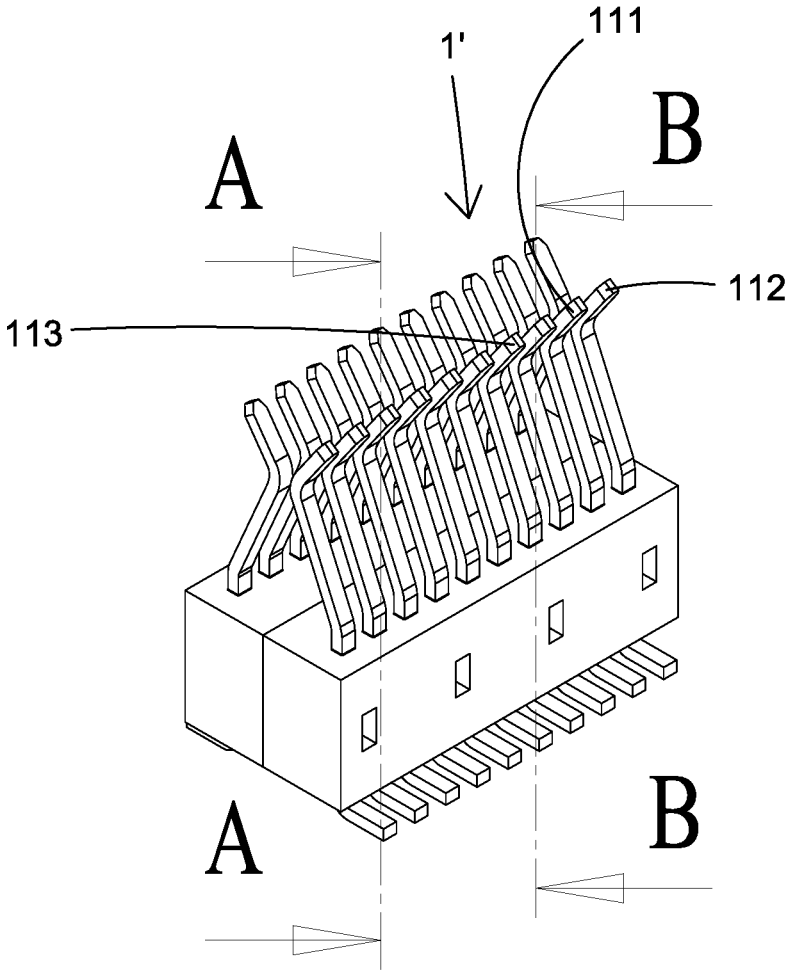
FIG. 7 is a schematic diagram showing a usage status of the electrical connector according to the present invention.

According to another purpose of the invention, the left terminal positioning portion 123 includes a left terminal gripping structure 1231 for gripping the left terminal 112, and the right terminal positioning portion 124 includes a right terminal gripping structure 1241 for gripping the right terminal 113 (as shown in FIGS. 5 and 6).

Moreover, as shown in FIGS. 5 and 6, a left terminal clamping structure 1232 and a right terminal clamping structure 1242 can respectively be formed on the left terminal positioning portion 123 and the right terminal positioning portion 124 to clamp and position the left terminal 112 and the right terminal 113 respectively, so as to reduce shifting of the left terminal 112 and the right terminal 113.

The insulating housing 13 includes a housing body 131, at least one middle terminal positioning portion 132 and a terminal base positioning portion 133. The middle terminal positioning portion 132 and the terminal base positioning portion 133 are provided on the housing body 131, for respectively positioning the middle terminal 111 and the terminal base 12, wherein both ends of each of the middle terminal 111, the left terminal 112 and the right terminal 113 are allowed to be respectively extended in a predetermined direction and beyond the housing body 131, so as to form a finished electrical connector shown in FIG. 1.

Accordingly, as shown in FIG. 4, the terminal base 12 can further include an insulating housing embedding structure 126 for being embedded in the insulating housing 13.

Accordingly, in this embodiment of the present invention, the middle terminal positioning portion 132 includes a middle terminal embedding structure 1321 (shown in FIGS. 8 and 12) for positioning and embedding the middle terminal 111, and the terminal base positioning portion 133 includes a terminal base embedding structure 1331 (shown in FIGS. 6 and 9) for positioning and embedding the terminal base 12.

Accordingly, in this embodiment of the present invention, the terminal base 12 can further include a terminal base coupling portion 125 (shown in FIG. 4), and correspondingly, the insulating housing 13 can further include a terminal base exposing structure 134 (shown in FIGS. 4 and 6). The terminal base exposing structure 134 is formed on the housing body 131, for exposing the terminal base coupling portion 125 of the terminal base 12 and making it able to provide electrical coupling, so as to form the electrical connector 1 shown in FIG. 2. By this configuration, grounding terminals of two electrical connectors 1 can be electrically connected to each other to form an electrical connector set 1' (shown in FIG. 7) that can be mounted to a circuit substrate 2 (shown in FIG. 13).

Figure 14:
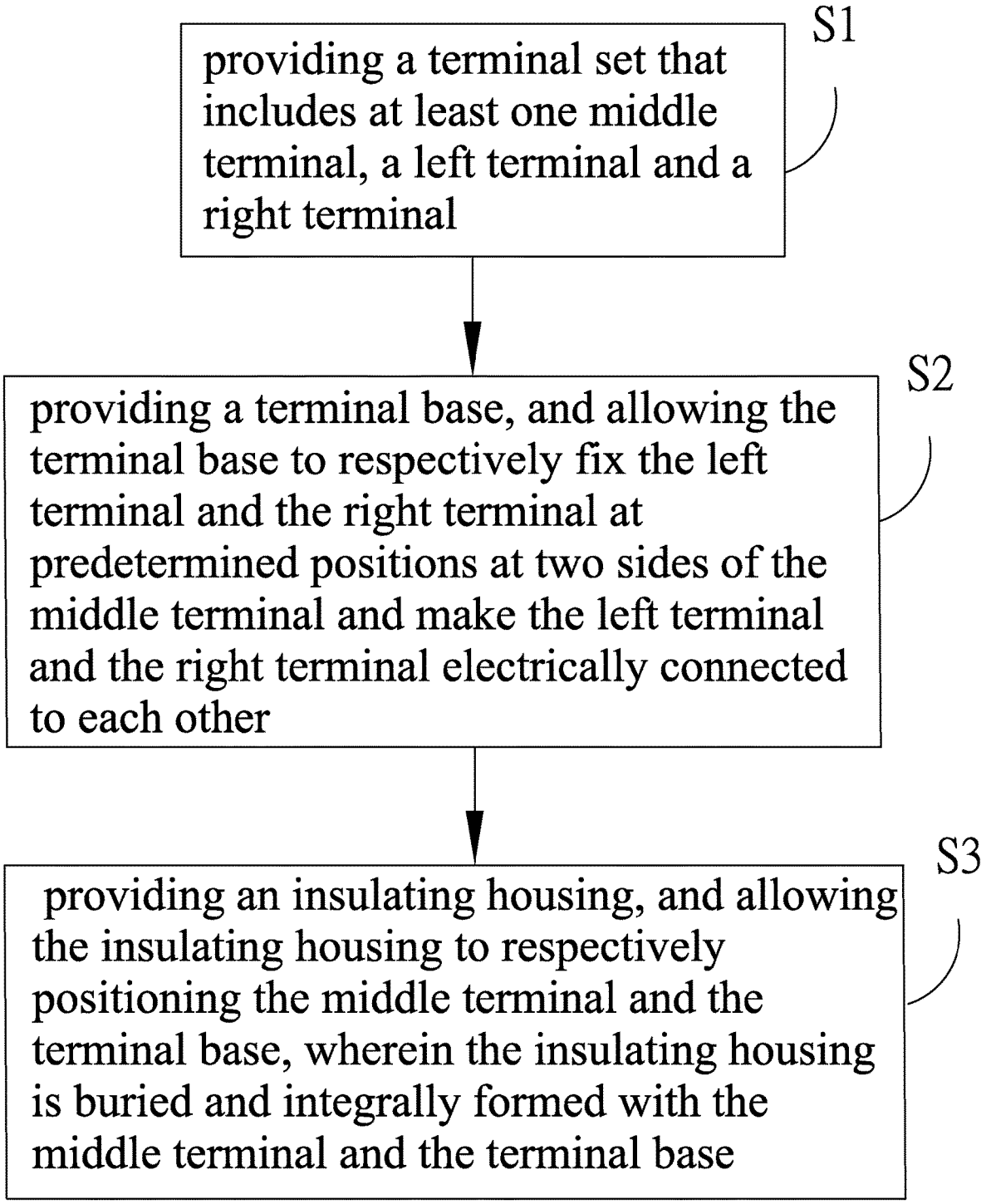
FIG. 14 is a flowchart of a manufacturing method of the electrical connector according to the present invention.

As shown in FIG. 14, the manufacturing method of the electrical connector according to the present invention includes the following steps.

In step S1, a terminal set is provided, which includes at least one middle terminal, a left terminal and a right terminal.

In step S2, a terminal base is provided. The terminal base is allowed to respectively fix the left terminal and the right terminal at predetermined positions at two sides of the middle terminal and make the left terminal and the right terminal electrically connected to each other. The terminal base can use, for example, gripping or clamping technique, to respectively position and electrically connect the left terminal and the right terminal of the terminal set so as to form an electrical connector semi-manufacture.

In step S3, an insulating housing is provided and allowed to respectively position the middle terminal of the terminal set and the terminal base, wherein both ends of each of the middle, left terminal and the right terminal are allowed to be respectively extended in a predetermined direction and beyond the insulating housing. The insulating housing is integrally formed with the middle terminal and the terminal base by burying technique, so as to complete a finished electrical connector. Preferably, the insulating housing allows a part of the terminal base to be exposed to provide electrical coupling. Moreover, the insulating housing can use, for example, gripping and assembling technique, to respectively position the middle terminal and the terminal base.

Therefore, the present invention provides an electrical connector and a manufacturing method thereof, which not only simplify producing procedures of the electrical connector and reduce mold and manufacturing costs, but also use a terminal base to position a plurality of grounding terminals and thus prevent them from shifting, thereby improving reliability of the electrical connector. Moreover, the terminal base can further allow the plurality of grounding terminals to be electrically connected to each other, such that no jumper is needed to form such electrical connection between the grounding terminals as desired.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. An electrical connector including:

a terminal set including at least one middle terminal, a left terminal and a right terminal;

a terminal base including a base body, at least one middle terminal channel, a left terminal positioning portion and a right terminal positioning portion, wherein the middle terminal channel is located in the base body and for allowing the middle terminal to penetrate therethrough and preventing the middle terminal from touching the base body, and the left terminal positioning portion and the right terminal positioning portion are provided on the base body and for respectively fixing the left terminal and the right terminal at predetermined positions at left and the right sides of the middle terminal and allowing the left terminal and the right terminal to be electrically connected to each other, so as to form an electrical connector semi-manufacture; and an insulating housing including a housing body, at least one middle terminal positioning portion and a terminal base positioning portion, wherein the middle terminal positioning portion and the terminal base positioning portion are provided on the housing body, and for respectively positioning the middle terminal and the terminal base of the electrical connector semi-manufacture, and allowing both ends of each of the middle, left terminal and the right terminal to be respectively extended in a predetermined direction and beyond the housing body, so as to form a finished electrical connector, wherein the terminal base is a conductive plastic terminal base.

2. The electrical connector according to claim 1, wherein the terminal base further includes a terminal base coupling portion, and the insulating housing further includes a terminal base exposing structure formed on the housing body and for exposing the terminal base coupling portion to make it able to provide electrical coupling.

3. The electrical connector according to claim 1, wherein the left terminal positioning portion includes a left terminal gripping structure for gripping the left terminal, and the right terminal positioning portion includes a right terminal gripping structure for gripping the right terminal.

4. The electrical connector according to claim 1, wherein the left terminal clamping structure and a right terminal clamping structure is respectively be formed on the left and the right terminal positioning portions to clamp and position the left terminal and the right terminal respectively.

5. The electrical connector according to claim 1, wherein the middle terminal positioning portion includes a middle terminal embedding structure for positioning and embedding the middle terminal, and the terminal base positioning portion includes a terminal base embedding structure for positioning and embedding the terminal base.

6. The electrical connector according to claim 1, wherein the terminal base includes an insulating housing embedding structure for being embedded in the insulating housing.

7. The electrical connector according to claim 1, wherein the middle terminal is a signal terminal, the left terminal and the right terminal are grounding terminals.

8. A manufacturing method of an electrical connector, including the steps of:

providing a terminal set that includes at least one middle terminal, a left terminal and a right terminal;

providing a terminal base that includes a base body, at least one middle terminal channel, a left terminal positioning portion and a right terminal positioning portion, wherein the middle terminal channel is located in the base body and for allowing the middle terminal to penetrate therethrough and preventing the middle terminal from touching the base body, and the left terminal positioning portion and the right terminal positioning portion are provided on the base body and for respectively fixing the left terminal and the right terminal at predetermined positions at left and the right sides of the middle terminal and allowing the left terminal and the right terminal to be electrically connected to each other, so as to form an electrical connector semi-manufacture; and providing an insulating housing, and allowing the insulating housing to respectively position the middle terminal and the terminal base of the electrical connector semi-manufacture, wherein both ends of each of the middle, left terminal and the right terminal are allowed to be respectively extended in a predetermined direction and beyond the insulating housing, so as to form a finished electrical connector, wherein the insulating housing is buried and integrally formed with the middle terminal and the terminal base, and the terminal base is a conductive plastic terminal base.

9. The electrical connector manufacturing method thereof according to claim 8, wherein the insulating housing is for exposing the terminal base and making it able to provide electrical coupling.

10. The electrical connector manufacturing method thereof according to claim 8, wherein the terminal base is gripping or clamping, to respectively the left terminal and the right terminal, and the insulating housing is gripping, to respectively the middle terminal and the terminal base.

* * * * *